US005794990A

United States Patent [19]

Coppedge

[11] Patent Number: 5,794,990

[45] Date of Patent: Aug. 18, 1998

[54] SAFETY LATCH FOR POOL FENCE

[75] Inventor: Donald L. Coppedge, Stuart, Fla.

[73] Assignee: Protect-A-Child Pool Fence Systems, Pompano Beach, Fla.

[21] Appl. No.: 782,127

[22] Filed: Jan. 13, 1997

[51] Int. Cl.[6] ..... E05C 1/04; E04H 17/14

[52] U.S. Cl. ..... 292/153; 292/145; 292/146; 256/25; 256/47; 256/65

[58] Field of Search ..... 411/340–346, 388, 411/389; 256/47, 50, 54, 25, 65; 220/319, 320, 686; 292/153

[56] References Cited

U.S. PATENT DOCUMENTS

| | | | |
|---|---|---|---|
| 525,459 | 9/1894 | Hill | 220/686 |
| 2,081,323 | 5/1937 | Cordes | 411/342 |
| 2,553,220 | 5/1951 | Troeger | 220/320 |
| 4,380,327 | 4/1983 | Fish | 256/24 |
| 4,926,953 | 5/1990 | Platt | 411/435 |
| 5,512,508 | 10/1992 | Fish | 256/24 |
| 5,553,833 | 9/1996 | Bohen | 256/65 |
| 5,584,410 | 12/1996 | Siblik | 220/320 |

*Primary Examiner*—Steven N. Meyers
*Assistant Examiner*—Tuyet-Phuong Pham
*Attorney, Agent, or Firm*—David Kiewit

[57] ABSTRACT

A child-proof safety latch for a swimming pool safety barrier, or other stretched-panel fence, includes a threaded rod having an expandable nut, such as a toggle-wing nut, that can move to and fro along the rod between a movable stop and a fixed stop adjacent an end of the rod that is distal from a first fence pole to which the rod is permanently affixed. To fasten two adjacent fence panels together, an operator collapses the expandable nut and inserts it through an eyelet attached to a second fence pole. The operator then expands the nut so as to capture the eyelet and turns the expandable nut so as to draw the two poles together.

7 Claims, 2 Drawing Sheets

SAFETY LATCH FOR POOL FENCE

BACKGROUND OF THE INVENTION

1. Field of the Invention

The invention relates to gate latches, particularly those used with stretched-panel fences of the sort used as a swimming pool safety barrier.

2. Description of Prior Art

Swimming pool safety barriers are commonly stretched-panel fences with flexible, lightweight panels (e.g., made of woven nylon mesh and having top and bottom reinforcing ropes) clamped to poles slid into mounting receptacles. Descriptions of barriers of this sort are found in Fish's U.S. Pat. No. 4,380,327 and U.S. Pat. No. 5,152,508, and in Bohen's U.S. Pat. No. 5,553,833, the latter of which is assigned to the assignee of the present invention. The disclosure of Bohen's U.S. Pat. No. 5,553,833 is herein incorporated by reference.

These safety barriers are commonly erected around swimming pools to save small children from accidental drowning, and are temporarily removed when the pool is used. A gate section in these fences commonly features a latch, or end closure, that is easily operated by an adult. It is clear, from the intended use of the fence, that such a latch or closure should be essentially child-proof. Initially, end closures on stretched-panel pool fences served the apparent dual purposes of prohibiting access to a child and of maintaining tension in the stretched panels. In these fences maintaining the tension was actually an essential part of prohibiting access because the fence poles could be easily lifted from their mounting holes adjacent the pool when the panel tension was relaxed. In accordance with the teaching of Bohen, in U.S. Pat. No. 5,553,833, of a keyed socket for retaining the poles of a stretched-panel fence, the requirement of maintaining panel tension is obviated, but that of prohibiting a small child from opening the gate, while permitting access to an adult, remains.

Closures for pool safety fences have included a simple hook-and-eye latch, as shown in FIGS. 5 and 6 of Fish's U.S. Pat. No. 5,152,508; a hook-and-eye latch having a spring-loaded tang with a spring that was intended to be too stiff to be operated by a small child (but that unfortunately was not always stiff enough), as is shown by Bohen in U.S. Pat. No. 5,553,833; and a conventional safety gate hook, which is the most widely used.

SUMMARY OF THE INVENTION

The invention provides an end closure comprising an eyelet or other aperture associated with a first fence panel and a threaded fastener attached to a second fence panel that is to be latched to the first fence panel. The threaded fastener comprises an axially expandable member moving along a threaded rod having a first stop means adjacent one end thereof. The expandable member has an expanded state in which it will not pass through the eyelet and a collapsed state in which it will pass through the eyelet. In a preferred embodiment the fastener further comprises a second stop means that is also moveable along the rod. When the second stop means is adjacent the expandable member, the expandable member is prohibited from being in the collapsed state.

In a specific preferred embodiment the end closure of the invention comprises a first screw eyelet screwed into a first pole defining an end of one of the panels of a stretched-panel fence. The threaded fastener comprises a second, long-shanked, eyelet having a machine screw thread disposed on the shank. The second eyelet is linked to a third screw eyelet that is screwed into a second pole defining the end of a second of the panels in the desired end closure. A jam nut and a toggle-wing nut are threaded onto the long-shanked eyelet, or eyebolt, and a fixed stop means is supplied at the free end of the eyebolt by mechanically deforming the bolt so that neither the toggle-wing nut nor the jam nut can be threadably removed from the eyebolt.

It is an object of the invention to provide end closure means for a stretched-panel fence, the end closure means adjustable in length to account for variations in dimensions of other elements of the fence, e.g., for variations in pole-to-pole gaps between sections.

It is an additional object of the invention to provide a child-resistant latching means comprising two or more threaded fasteners that can be screwed together tightly enough to prevent a small child from opening the closure, but that can be unscrewed by an adult without the use of additional tools.

It is yet a further object of the invention to provide an end closure means for a stretched-panel fence that is made entirely from corrosion-resistant parts so as to provide a weather-proof closure.

DETAILED DESCRIPTION OF THE PREFERRED EMBODIMENT

Figure 1:
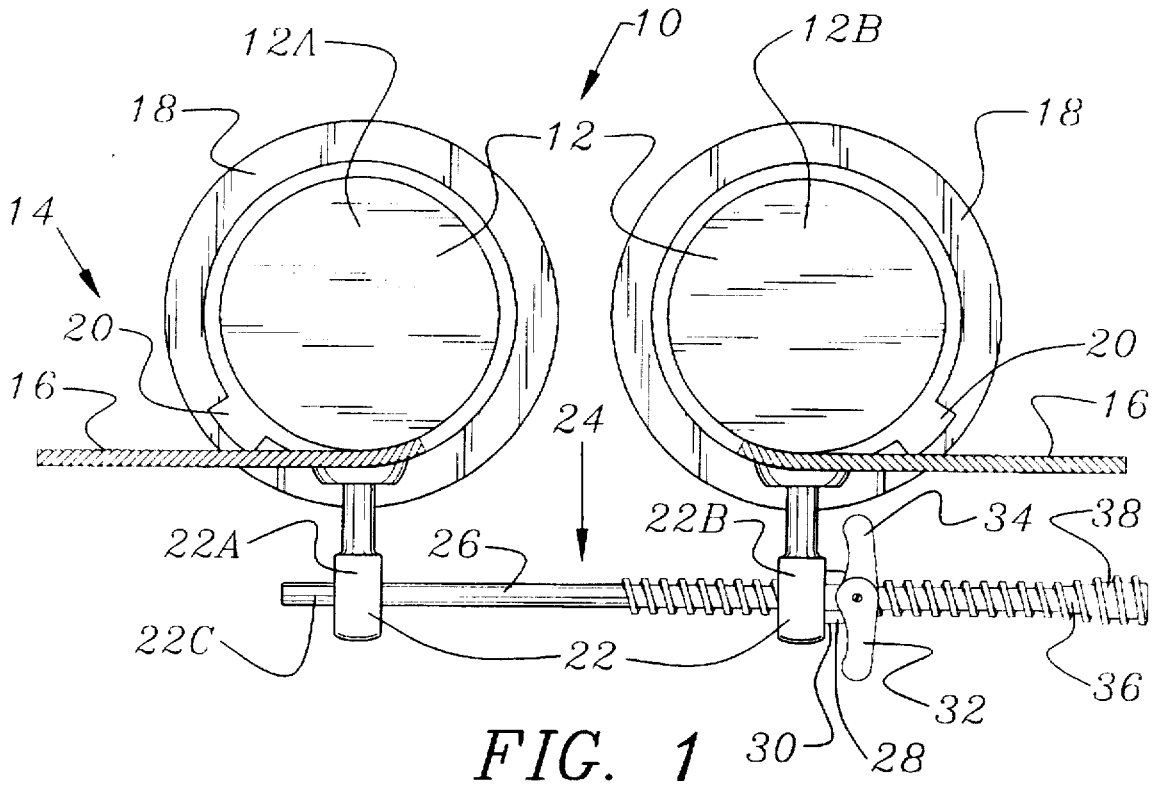
FIG. 1 is a plan view of a preferred embodiment of a latch of the invention attaching two sections of a stretched-panel fence.

A latch 10 of the invention detachably connects two adjacent poles 12 of a stretched-panel fence 14, which preferably comprises a plurality of stretched panels 16, each of the panels 16 respectively extending between two keyed poles 12 inserted into sockets 18 having keyways 20 cut therein as taught by Bohen in U.S. Pat. No. 5,553,833. Each of the two poles 12 to be connected may have an eyelet 22 fixedly attached to it and extending radially outward from the axis of the pole In the preferred embodiment depicted in FIG. 1, each of the two poles 12 has a conventional screw eyelet 22 extending outward therefrom, and the two eyelets are detachably fastened together by a threaded fastener 24 that is permanently attached to a first 12A of the two poles 12 (e.g., by interlocking an eyelet 22A screwed into the first pole 12A with an eyelet 22C integrally formed on a threaded rod 26 portion of the threaded fastener 24). The fastener 24 also comprises a first stop means 28 (which is preferably a jam nut 30) and an expandable nut 32 (which is preferably a well-known toggle-wing nut 34) threaded thereonto for screw motion therealong. A fixed stop means 36, which may be a deformed portion 38 of the threaded rod 26, is provided adjacent one end of the threaded rod 26 to prevent the expandable nut 32 and first stop means 28 from being completely unscrewed from the rod 26.

In order to latch the two fence panels 16 together, an adult operator collapses the toggle-wing nut 34 by squeezing the two wings against the force of the bias spring contained therein and passes the collapsed expandable nut 34 through an aperture or eyelet 22B fixedly attached to the second fence pole 12B. He or she then allows the toggle-wing nut to expand to its normal expanded state, and turns it about the threaded rod 26 so as to urge the now captured eyelet 22B, and the pole 12B from which it extends, toward the first pole 12A until the combination of the jam nut 30, the captured eyelet 22B and the expandable nut 32 are tightened together with sufficient force that a small child can not unscrew the latch 10. Although it is conventional to make toggle-wing nuts having a bias spring urging the wings apart from each other, and this feature makes the operation of the fastener of the invention more convenient, it may be noted that the bias spring is not essential for the present invention.

In the preferred embodiment, the jam nut 30 is a conventional hexagonal nut 30*a* having a diameter small enough so that it can pass through the eyelet 22B, in which case the expandable nut 32 bears on the eyelet 22B when the two poles 12A, 12B are drawn together. It may be noted that other arrangements may also be employed, and include the use of a wing nut 30*b*, or other fastener that is too large to fit through the eyelet 22B so that the eyelet 22B is captured between the expandable nut 32 and the jam nut 30.

Figure 2:
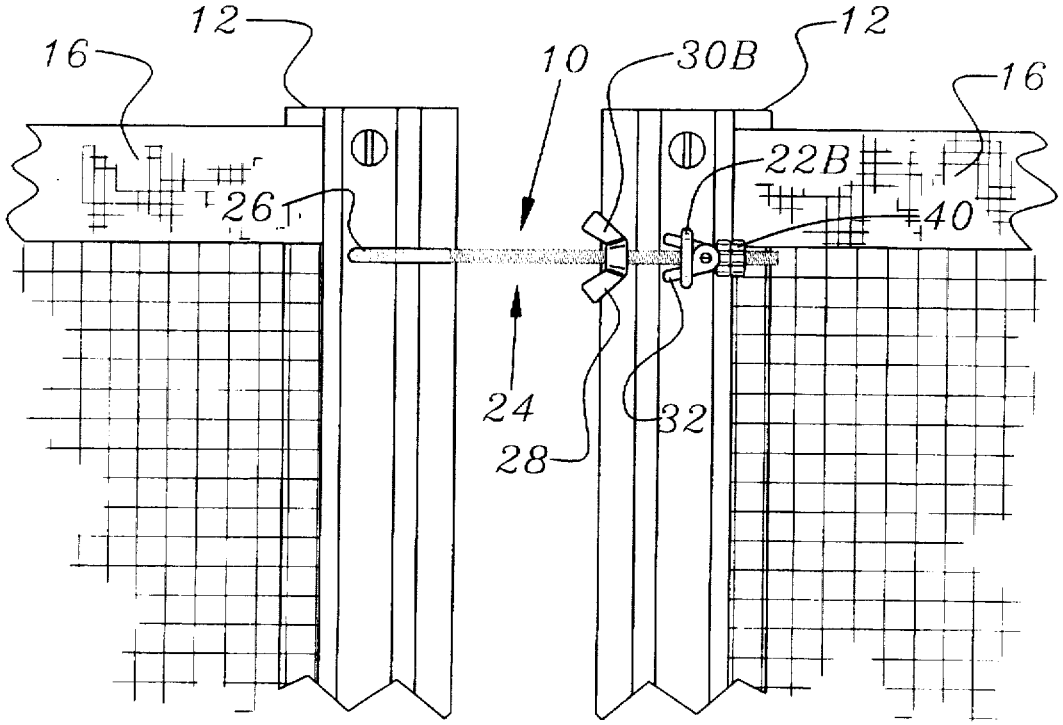
FIG. 2 is a front elevational view of another embodiment of the latch.
Figure 3:
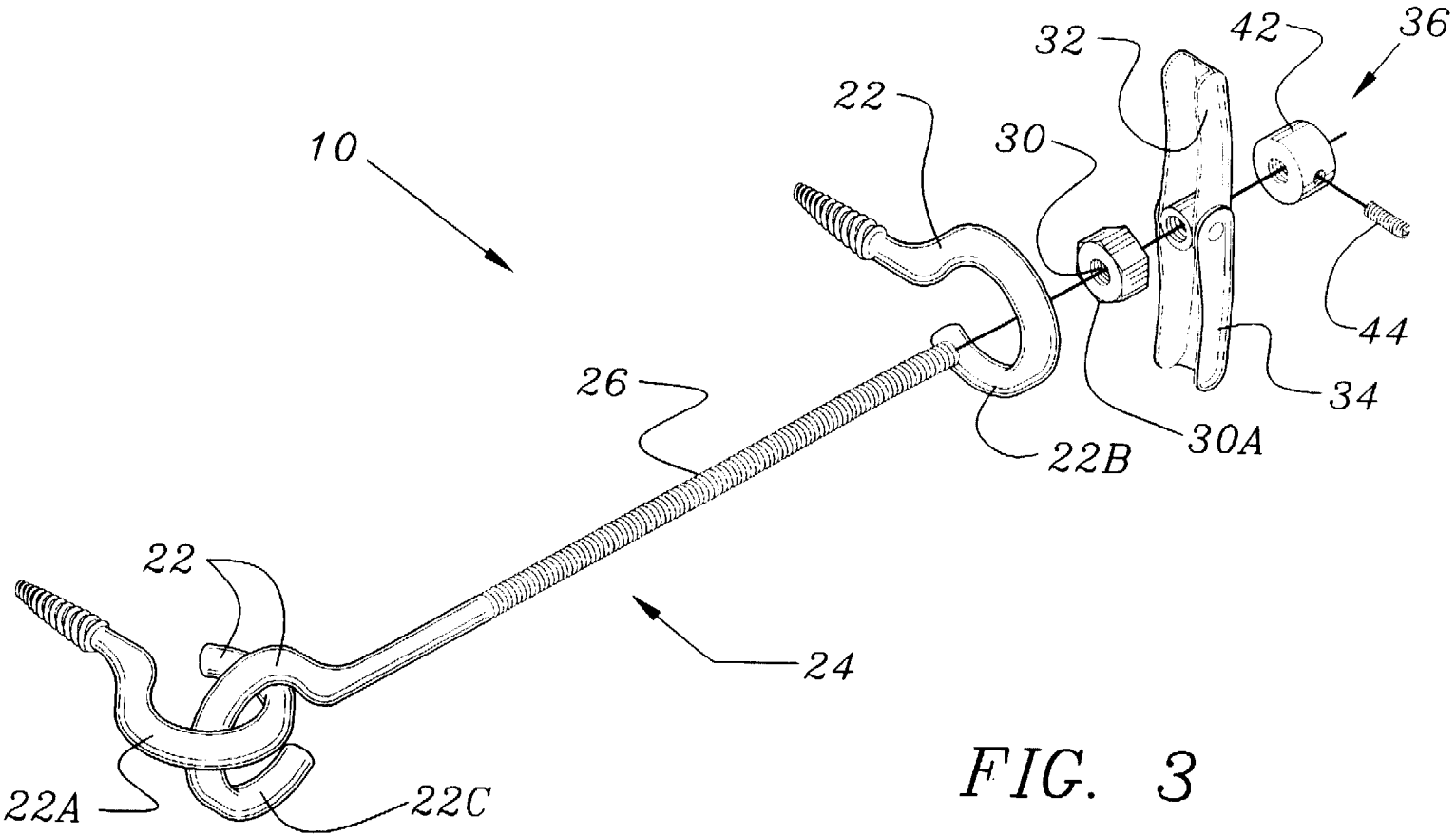
FIG. 3 is an exploded view of the preferred embodiment.

In the preferred embodiment the threaded fastener 24 is connected to the first pole 12A by flexible attachment means, such as the interlocking eyelets 22A, 22C depicted in FIGS. 1 and 3. A flexible attachment of this sort is believed to provide greater operator safety by not having a rod or spike that could injure a careless operator if it was fixedly attached to one of the poles 12. It should be clear to those skilled in the art, however, that the threaded fastener 24 could be rigidly attached to one of the poles (e.g., by using the ell-shaped threaded rod 26 depicted in FIG. 2, where a self-tapping thread on the short side of the ell allows the rod 24 to be screwed into the pole and a machine screw thread cut into the long side of the ell allows the nuts 30, 32 to threadably move therealong.

It will be recognized by those skilled in the art that although the preferred embodiment provides a threaded fastener 24 attached to a first fence pole 12A cooperating with an eyelet 22A fixedly attached to a second pole 12B to removably form an end closure, there are many sorts of apertures functionally equivalent to the eyelet 22A. One could, for example, employ a second fence pole 12B having an aperture integrally formed therethrough—e.g., by supplying a throughhole in the web of an I-beam portion of the second pole.

As noted supra, a fixed stop 36 is provided at the end of the fastener 24 distal from its attachment to the first pole 12A. In the preferred embodiment depicted in FIG. 1 this stop 36 is made by deforming the distal end of the rod 26 sufficiently that the nuts 30, 32 can not be unscrewed from the rod, the deformation made after the jam nut 30 and expandable nut 32 have been threaded onto the rod 26. Many other approaches to providing the same function are known to the art and include, inter alia, a pair 40 of nuts jammed together at the distal end of the rod (i.e., as depicted in FIG. 2), and the combination of a cap nut 42 and locking screw 44 depicted in FIG. 3.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

I claim:

1. A stretched-panel fence comprising a plurality of panels, each of the panels extending respectively between two poles of a plurality of poles, the fence comprising an end closure removably attaching a first of the poles associated with a first panel but nut with a second panel, to a second of the poles associated with the second panel, the closure comprising:

an aperture associated with the first pole;

an elongate threaded fastener comprising a rod having two ends, the first of the two ends attached to the second pole, the threaded fastener further comprising:

a first stop means adjacent the second of the two ends of the rod, a second stop means adapted move along the rod; and an expandable member adapted to threadably move along the rod between the first stop means and the second stop means;

wherein the expandable member has a collapsed state and an open state, the expandable member adapted to pass through the aperture when in the collapsed state, the expandable member not passing through the aperture when in the open state.

2. The fence of claim 1 wherein the aperture comprises an eyelet fixedly attached to the first pole.

3. The fence of claim 1 wherein the first end of the threaded fastener is attached to the second pole by means comprising a first eyelet adjacent the first end of the threaded rod, the first eyelet linked to a second eyelet fixedly attached to the second pole.

4. The fence of claim 1 wherein the first stop means comprises a deformed portion of the rod, the second stop means comprises a nut and the expandable member comprises a toggle-wing nut.

5. A method of removably attaching a first pole to a second pole in a stretched-panel fence comprising a plurality of panels, each of the panels extending respectively between two of a plurality thereof, wherein the first pole is associated with a first panel and not with a second panel, and wherein the second pole is associated with the second panel, the method comprising the steps of:

a) attaching a first end of a fastener comprising a threaded rod to the second pole;

b) collapsing an expandable member comprising a nut threaded onto the threaded rod c) passing the collapsed expandable member through an aperture associated with the first pole;

d) expanding the expandable member so that it can no longer pass through the aperture, thereby capturing the first pole between the expandable member and the second pole; and e) turning the nut about the threaded rod to urge the first and the second poles together.

6. The method of claim 5 wherein the aperture comprises an eyelet fixedly attached to the first pole.

7. An apparatus in combination with a stretched-panel fence having two fence poles, each of the two poles respectively associated with a separate one of a plurality of panels of the fence, the apparatus comprising:

a first eyelet fixedly attached to a first of the two poles;

a second eyelet fixedly attached to the second of the two poles;

an eyebolt having two ends, an eyelet portion of the eyebolt adjacent a first end thereof linked with the second eyelet to attach the eyebolt to the second pole, the eyebolt having a deformed portion at the second end thereof, the deformed portion prohibiting a nut threaded onto the eyebolt from being unscrewed therefrom;

a toggle-wing nut threaded onto the eyebolt adjacent the second end thereof, the toggle-wing nut having a collapsed state in which the toggle-wing nut is adapted to pass through the first eyelet, the toggle-wing nut having an expanded state in which the toggle-wing nut does not pass through the first eyelet; and a jam nut threaded onto the eyebolt between the toggle-wing nut and the first end of the eyebolt.

* * * * *

UNITED STATES PATENT AND TRADEMARK OFFICE

CERTIFICATE OF CORRECTION

PATENT NO. : 5,794,990

DATED : August 18, 1998

INVENTOR(S) : Coppedge

It is certified that error appears in the above-identified patent and that said Letters Patent is hereby corrected as shown below:

Column 4, line 3,

Claim 1, change the word " nut " to read – not --.

Signed and Sealed this

Eighth Day of December, 1998

*Attest:*

*Attesting Officer*

BRUCE LEHMAN

*Commissioner of Patents and Trademarks*